United States Patent [19]

Fischer

[11] Patent Number: 4,829,160

[45] Date of Patent: May 9, 1989

[54] ELECTRIC COOKER PLATE

[76] Inventor: Karl Fischer, 7519 Obderderdingen, Am Gaensberg, Fed. Rep. of Germany

[21] Appl. No.: 245,541

[22] Filed: Mar. 19, 1981

Related U.S. Application Data

[63] Continuation-in-part of Ser. No. 968,047, Dec. 8, 1978, abandoned.

[30] Foreign Application Priority Data

Dec. 14, 1977 [DE] Fed. Rep. of Germany ..... 2755806
Dec. 14, 1977 [DE] Fed. Rep. of Germany ..... 2755807

[51] Int. Cl.[4] ..... H05B 3/70
[52] U.S. Cl. ..... 219/467; 219/457
[58] Field of Search ..... 219/457, 458, 459, 460, 219/461, 462, 463, 464, 465, 466, 467, 468, 447, 536, 432, 433; 126/214 A; D7/121

[56] References Cited

U.S. PATENT DOCUMENTS

| | | | |
|---|---|---|---|
| 2,664,492 | 12/1953 | Fischer | 219/457 |
| 3,300,621 | 1/1967 | Fischer | 219/458 |
| 3,838,249 | 9/1974 | Dettenbeck | 219/467 X |

FOREIGN PATENT DOCUMENTS

| | | | |
|---|---|---|---|
| 82791 | 4/1957 | Denmark | 219/457 |
| 99599 | 8/1964 | Denmark | 219/457 |
| 1250025 | 9/1947 | Fed. Rep. of Germany . | |
| 904672 | 7/1949 | Fed. Rep. of Germany | 219/457 |
| 1726413 | 6/1956 | Fed. Rep. of Germany . | |
| 1004786 | 3/1957 | Fed. Rep. of Germany . | |
| 1021967 | 6/1958 | Fed. Rep. of Germany . | |
| 1774264 | 9/1958 | Fed. Rep. of Germany . | |
| 1786955 | 4/1959 | Fed. Rep. of Germany . | |
| 1849432 | 4/1962 | Fed. Rep. of Germany . | |
| 1130574 | 5/1962 | Fed. Rep. of Germany | 219/457 |
| 1127007 | 10/1962 | Fed. Rep. of Germany . | |
| 1165175 | 9/1964 | Fed. Rep. of Germany . | |
| 1291032 | 3/1969 | Fed. Rep. of Germany . | |
| 1188744 | 7/1969 | Fed. Rep. of Germany . | |
| 1288704 | 9/1969 | Fed. Rep. of Germany . | |
| 1565512 | 2/1970 | Fed. Rep. of Germany . | |
| 6604803 | 2/1970 | Fed. Rep. of Germany . | |
| 1565529 | 4/1970 | Fed. Rep. of Germany . | |
| 1565528 | 4/1970 | Fed. Rep. of Germany . | |
| 1554732 | 4/1970 | Fed. Rep. of Germany . | |
| 1811900 | 7/1970 | Fed. Rep. of Germany . | |
| 2620004 | 1/1978 | Fed. Rep. of Germany . | |
| 2735426 | 2/1979 | Fed. Rep. of Germany . | |
| 29232 | 3/1961 | German Democratic Rep. | 219/457 |
| 605897 | 6/1960 | Italy | 219/457 |
| 81889 | 8/1952 | Norway | 219/457 |
| 84398 | 8/1954 | Norway | 219/457 |
| 158713 | 9/1953 | Sweden | 219/457 |
| 305675 | 5/1955 | Switzerland | 219/457 |

*Primary Examiner*—Teresa J. Walberg
*Attorney, Agent, or Firm*—Steele, Gould & Fried

[57] ABSTRACT

An electric cooker comprises a fitting plate having an opening surrounded by an upwardly directed rim, a cooker plate received in the opening, the plate having a cooking surface on which a cooking vessel can be placed, and a sheet metal ring surrounding the cooker plate and projecting beyond the cooker plate. The sheet metal ring has an internal section which rests against the cooker plate and an external section which extends downwards at a particular low incidence and engages beyond the upwardly-directed rim of the fitting plate. The sheet metal ring is shaped and arranged on the electric cooker plate so that the transition from fitting plate to cooking surface allows cooking vessels to be pushed smoothly from the cooking surface on to the fitting plate, and vice versa. This is achieved by having a minimal elevation of the cooking surface over the fitting plate and/or by inter-adapted bevelling of the cooker plate, the sheet metal ring and the fitting plate. Capillary action tending to draw spilled liquids into the cooker is minimized by construction featuring sharp edges at all junction points.

3 Claims, 5 Drawing Sheets

ELECTRIC COOKER PLATE

CROSS REFERENCE TO RELATED APPLICATIONS

This is a Continuation in Part of my copending application Ser. No. 968,047, filed Dec. 8, 1978 now abandoned.

FIELD OF THE INVENTION

This invention relates to an electric cooker plate.

BACKGROUND OF THE INVENTION

Electric Cooker plates are often mounted in openings provided in fitting plates of stoves or the like having a raised rim which surrounds the cooker-receiving opening and ostensibly prevents spilled liquids from penetrating through the stove surface, the raised rim having a relatively large height, for example, more than 20 mm. A sheet metal ring surrounding the cooker plate has a steep external section whose lower rim rests against a support shoulder. The cooking surface therefore lies considerably above the fitting plate so that it is difficult or impossible to push cooking vessels onto or off of the cooker plate without lifting them or spilling the contents of fully loaded vessels.

An object of the invention is to provide an electric cooker plate which allows relatively shallow vessels or fully loaded vessels to be shifted more easily on the stove without impairing safety from penetration of spilled liquids. The rim region of the cooker plate will also be easier to clean.

BRIEF SUMMARY OF THE INVENTION

According to the invention there is provided an electric cooker comprising a fitting plate having an opening surrounded by an upwardly-directed rim, a cooker plate mounted in the opening, the plate having a cooking surface on which a cooking vessel can be placed, and a sheet metal ring surrounding the cooker plate and projecting beyond the cooker plate. The sheet metal ring has an internal section which rests against the cooker plate and an external section which extends generally downwards at a low incidence and engages the fitting plate beyond the upwardly-directed rim. The sheet metal ring is shaped and arranged on the electric cooker plate so that a transition enabling cooking vessels to be pushed smoothly from the cooking surface on to the fitting plate is created by the provision of (a) a small distance between the cooking surface and the fitting plate, (b) interadapted bevelling of the cooker plate, the sheet metal ring and the fitting plate, and (c) edge contact between cooker plate, sheet metal ring and fitting plate.

The invention includes several embodiments which are particularly advantageous individually or together. The sheet metal rings can be very flat but can still prevent penetration owing to their width and cooperation with the raised rims. The rings can reach the height of the cooking surface and thus reduce necessary height above the fitting plate. The sheet metal rings, the cooker plate rims and the fitting plate can also be shaped in such a way that together they form a continuous curve which allows the cooking vessel to be pushed on or off the cooking surface even if the fitting height is relatively large.

DETAILED DESCRIPTION OF THE PREFERRED EMBODIMENTS

Figure 1:
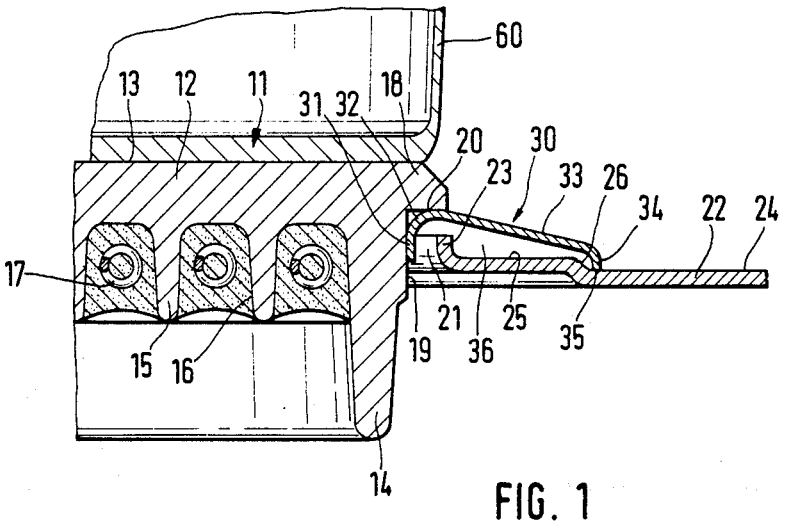
FIG. 1 shows a sectional view of the details of a rim of an electric cooker plate and the fitting thereof in a stove or fitting plate.

FIG. 1 shows an electric cooker plate 11 which has a cooker plate member 12 composed of cast iron or similar heat conductive material. Cooker plate 11 has an upper, closed, flat cooking surface 13 on which a cooking vessel 6 can stand, a downwardly-projecting external rim 14 and spiral ribs 15 on the underside in whose intermediate spaces 16 coiled heating wires 17 lie in an electrically insulating composition. The upper external rim of the plate member 12 comprises an outwardly projecting flange 18 upon which is formed a downward inclined shoulder 20 with an approximately cylindrical support surface 19.

The electric cooker plate 11 is inserted into an opening 21 in a fitting plate 22 which forms a sheet metal covering plate on an electric stove or hotplate or the like. The fitting plate contains several cooker plates and is inserted into a work surface of a kitchen unit. The opening 21 is limited by a raised rim 23, i.e. an upwardly projecting rim, formed by deformation of the fitting plate 22 which is surrounded by a surface 25 which is somewhat elevated relative to the surface 24 of the fitting plate and which is joined to the surface 24 via an S-shaped kink forming a centering shoulder 26 for the sheet metal ring and therefore the cooker plate. An approximately cylindrical internal section 31 of a sheet metal ring 30, preferably formed of approximately 0.4 mm thick stainless steel plate, is pressed against the support surface 19 with a force fit. The section 31 is connected to an external section 33 by a bend 32 which contacts the shoulder 20. The external section 33 consists of a flat, broad, frusto-conical member surrounding the cooker plate, co-axial with the cooker plate 11 and the opening 21. The section 33 leads to a narrow portion 34 which points downwards and terminates in a lower support edge 35 which lies on the surface 24 just beyond shoulder 26.

The axial height of the sheet metal ring is small in relation to the width of the cross-section of the ring. The width is advantageously from two to four times, and preferably three times, the height. The height of the internal section 31 is unimportant in this embodiment and does not affect the fitting height of the electric cooker plate since said plate is supported by shoulder 20 on ring 30. Owing to the low external section 33, 34 of the sheet metal ring, the cooking surface 13 lies at a minimum elevation above the surface 24. The only slightly inclined ramp shape of the external section simplifies cleaning and prevents a fully-loaded cooking vessel from tipping and spilling when it is pulled over this edge. The space 36 created between the surface 25 and the sheet metal ring, inside the cross-section of the sheet metal ring, forms a reservoir which has a relatively large height, thereby preventing spilled liquid from being drawn in to fill the gap by capillary action due to the surface tension of the liquid. In spite of the small height of the sheet metal ring (about half that of known rings), spilled liquid does not run from the surface 24 through the opening 21.

It will be appreciated that the tendency of spilled liquids to be drawn into the cavity 36 between sheet metal ring 30 and surface 25 is a function of a number of attributes of the geometry of the respective members. The present invention seeks to provide a workable construction which not only minimizes capillary action but does so in a unit that is easy to clean due to smooth transitions and an absence of depressions which constitute "dirt traps."

Capillary action tending to draw spilled liquids from surface 24 toward opening 21 is minimized by upward inclines encountered along such a path and by avoidance of close fits between lower and upper members, so far as practicable.

In a space having a vertical dimension less than or equal to the radius of a free standing drop of liquid, capillary action will occur. For water, the minimum space is on the order of 1–2 mm, this being the height that a drop of water will maintain due to surface tension, while standing on a plane such as surface 24. Other liquids will be drawn through greater or lesser spaces depending on the composition and viscosity of such liquids. Water and oil, as used in cooking, are of primary importance to this invention.

To minimize capillary action, space 36 is maintained at 2 to 5 mm, and preferably at 4 mm. To facilitate moving cooking vessels onto and off of cooking surface 13, the space should be small; however, to avoid capillary action, the space must exceed 2 mm.

Further attributes of the present invention are provided to minimize capillary action, to wit, upward inclines and junctions having sharp edge contact. With reference to FIG. 1, upward inclines occur at shoulder 26 and raised rim 23. Sharp edge contact occurs at edge 35 and between sheet metal rim 30 and downwardly-inclined flange 18 having shoulder 20. In accordance with the foregoing, it must be noted that, unless the junction between the respective members is complete (i.e., fluid tight), said junction must be of minimum transverse width.

The cooker plate rests on the support edge 35 and is held down by screws (not shown). The ring of the raised rim 23 need not perform any centering function. The sealing action is assisted by the fact that the highest portion of the space 36 lies in the vicinity of the cooker plate member beneath head 32, and the upper edge of the raised rim 23 lies there under head 32 as well. Thus, while the space between the respective parts may be less than 2 mm at that point, the larger spaces and upward inclines prevent spilled fluids from progressing to that point towards opening 21.

Figure 2:
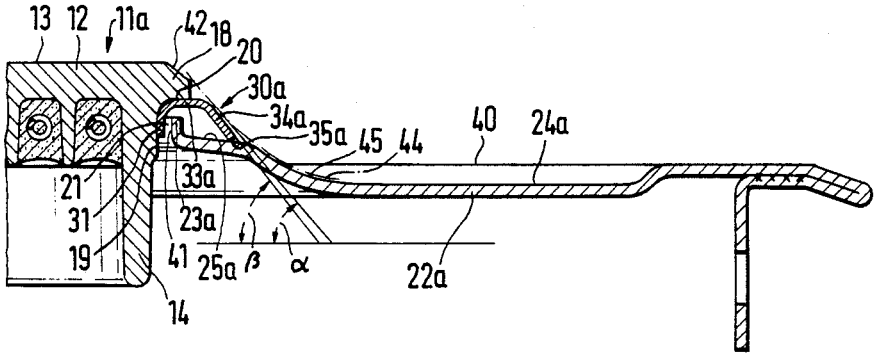
FIG. 2 shows a cross-section through part of an electric cooker plate mounted in a fitting plate.

FIG. 2 shows a supporting ring 30A which is of the same shape as ring 30 shown in FIG. 1, except for a horizontal intermediate section **33*a* which rests on the shoulder 20 and an external section 34*a* which is inclined at an angle $\beta$ (Beta) of about 45° to the ring axis and forms a conical casing surface coaxial with the cooker plate. The radii between the individual sections are large. It has been discovered that the conjunction of angle $\beta$ (Beta) of about 45° and the spacing limitations as discussed above provide a unit which is protected from liquids yet allows easy movement of cooking vessels. The external section 34*a* extends somewhat further down than the internal section 31. The sheet metal ring is less than 5 mm (preferably 4 mm) high. The lower sharp edge 35*a* of the support ring lies on the rim of a supporting shoulder 25*a*, which is elevated in relation to the surface 24*a* of the fitting plate 22*a*. The plate 22*a* also has an elevated external rim 40** tending to confine spilled liquids to the shallow depression thereby formed.

The fitting plate forms a flat tray (depth about 2 mm) and is bounded internally by the support shoulder **25*a* in the opening region, which does in fact lie less than 5 mm (preferably 4 mm) above the surface 24*a* and thus also above the external rim 40. Any water which boils over cannot remain on the support shoulder due to the angle thereof. A rounded section 45 of large radius joins surface 24*a* and support shoulder 25*a*. The support shoulder 25*a* forms an annular surface with a conical inclination of about 5° (at least below 8° ) dropping slightly outwards, further impeding impinging liquids. The internal limit of the support shoulder forms a raised rim 23*a* whose internal surface 41 limits the take-up opening 21**.

The internal surface 41 cooperates with the internal section 31 of the sheet metal ring **30*a* to center the cooker plate 11*a* in the opening 21, thus maintaining required spacing around the entire periphery of the cooker plate. The gap between these parts amounts on average to about 1.5 mm which is small enough for centering purposes and just large enough to avoid capillary action. The maximum possible lateral shifting of 1.5 mm does not allow cooking surface 13 to become oblique due to slipping of ring 30*a* over the slight inclination of the support shoulder 25*a*. The sheet metal ring 30*a*, in particular its bevelled external section 34*a* and the flange 18 with the chamfer 42 of the cooker plate are dimensioned and arranged relative to each other in such a way that they lie along a curve 44 which includes the rounded section 45. A continuous transition is thereby produced by the rounded section without substantial discontinuities to be encountered by a cooking vessel. The curve 44 should be connected smoothly to the rounded section 45 but the curve and the section 45 need not be the arcs of circles. In the embodiment, the curvature increases toward the rounded section 45. The largest inclination $\alpha$ of the curve which is attained just above the sheet metal ring 30*a* in the embodiment should amount to less than 45° (preferably about 40° ). The inclination $\beta$of the external section 34*a* is larger (less than 50° and preferably 45° ). This provides for good transfer of forces and linear contact (slight heat transfer) at the edge 35*a***.

Although the intermediate section **33*a* of the sheet metal ring projects somewhat beyond the flange 18, a smooth transition is produced in the course of the curve 44 so that the safety from penetration is ensured in spite of a flat fitting, the rim of the cooker plate can be cleaned particularly well, because all external sharp edges and bends are dispensed with, and a saucepan which is pulled from the cooking surface 13 reaches the surface 24*a*** without substantial obstruction along the way.

Figure 3:
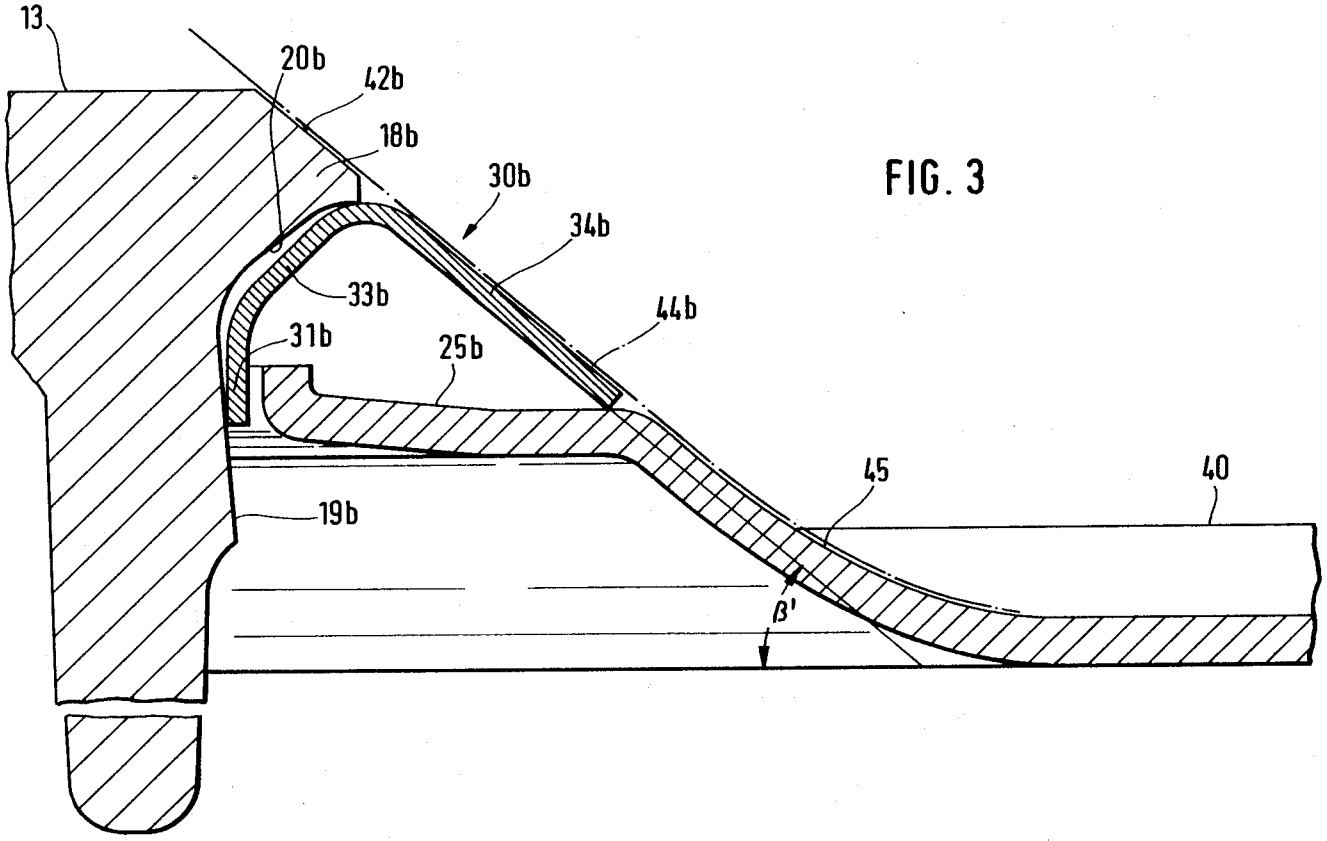
FIG. 3 shows a cross-section of an embodiment of the invention in detail.

In the embodiment shown in FIG. 3, the lower shoulder surface **20*b* of the flange 18*b* extends obliquely upwards in a curve and the chamfer 42*b*** is large so that the external circumferential surface of the cooker plate is very narrow.

The supporting ring 30b rests in the external region of the support shoulder 25b and its external section 34b has a flatter inclination than in the previous embodiment (Beta Prime [$\beta'$] is approximately 40° ). The intermediate section 33b follows approximately the shape of the shoulder 20b, obliquely or conically. The internal section 31b of the sheet metal ring 30b is approximately cylindrical and at least its lower region lies on the support surface 19b which is tapered slightly toward the top.

The curve 44b which, starting from the rounded section 45, connects the external section 34b of the sheet metal ring and the chamfer 42b has a radius in the region of the rounded section 45 which merges into a very extended or straight curved section. At the same time, the edge interconnections are of minimum width, and in conjunction with the angle $\beta$ of 45° and the gaps greater than 2 mm, impedes capillary action. The overall embodiment is advantageous in that it provides ease of cleaning, a pleasing appearance and a small fitting height. A small ledge is needed in the region of the support shoulder 25b in order to take-up the centering clearance.

Figure 4:
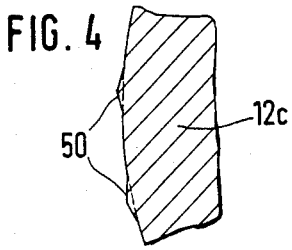
FIG. 4 shows a detailed section along line IV—IV in FIG. 5.
Figure 5:
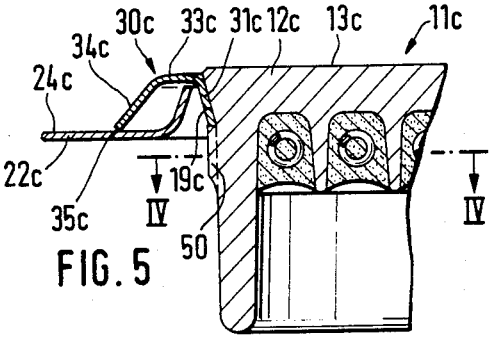
FIGS. 5 to 15 shows detailed sections through various embodiments.

FIGS. 4 and 5 show a cooker plate 11c in which the support surface 19c widens upwards in a conical fashion at an angle of 10° to 20° . The sheet metal ring 30c has a fitted conical internal section 31c and, as also in the embodiments of FIGS. 6 to 9, an approximately horizontal intermediate section 33c. A conical external section 34c rests on the surface 24c of a fitting plate 22c and supports the cooker plate. The intermediate section 33c lies only very slightly (1 to 2 mm) below the level of the cooking surface 13c, since the cooker plate does not have an external flange. Such a flange could not be easily produced so thinly and would likely break or corrode. Since the cooker is exactly fitted into the ring 30c, impinging liquids are blocked.

FIG. 4 shows that several projections or ribs 50 are molded on the circumference of the cooker plate below the support surface 19c over which the sheet metal ring is pushed from below and behind whose upper end the sheet metal ring clicks tightly and securely into position. It is closely dimensioned so that it is widened somewhat by the pushing operation and lies under stress on the support surface 19c and is sealed relative to the cooker plate member 12c when fully inserted. The connection is self-locking owing to the small conical angle so that the ribs 50 are used only for securing. The initial stress is sufficiently large for any differences in thermal expansion between the sheet metal ring and the cooker plate to be taken up resiliently and to preclude formation of a gap in which dirt could penetrate during operation and slowly widen the gap.

In the embodiments shown in FIGS. 4 to 12, the fitting height is very small and hardly larger than the height of the sheet metal ring. The raised rim therefore extends almost up to the cooker surface and the total fitting height is small in spite of a relatively high sheet metal ring.

Figure 6:
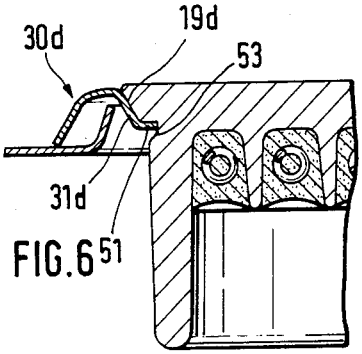

FIG. 6 shows a similar embodiment to that of FIGS. 4 and 5 in which support surface 19d and internal section 31d are somewhat steeper. The sheet metal ring 30d is secured by an inwardly bent lower rim 51 of the internal section which engages in a groove 53 on the cooker plate member, providing a complete seal.

Figure 7:
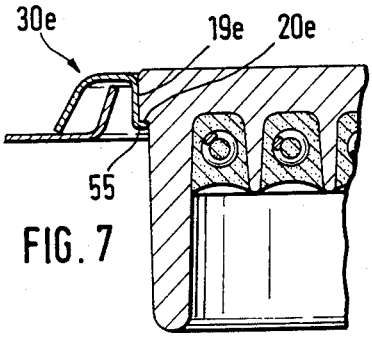

In FIG. 7, the support surface 19e is cylindrical and the sheet metal ring 30e is fixed by a force fit and by a rim 55 bent inwards beneath a shoulder 20e.

Figure 8:
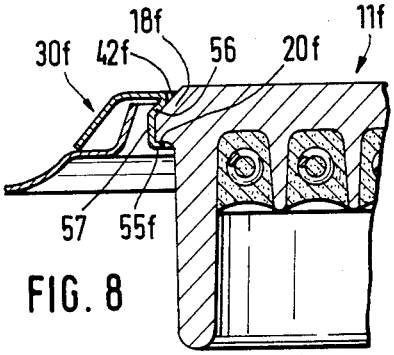

FIG. 8 shows a conventional cooker plate 11f with an external flange 18f and a chamfer 42f over which a section 56 of the sheet metal ring 30f engages. A rim 55f is connected to a cylindrical member 57 which engages behind a shoulder 20f. Fixing can be achieved by pushing the sheet metal ring from below and deforming it in order to form the section 56 or by pushing from above with the finished section 56 and forming the rim 55f or corresponding individual flaps. Although a standard cooker plate is employed, the arrangement stays clean and does not impede movement of cooking vessels appreciably.

Figure 9:
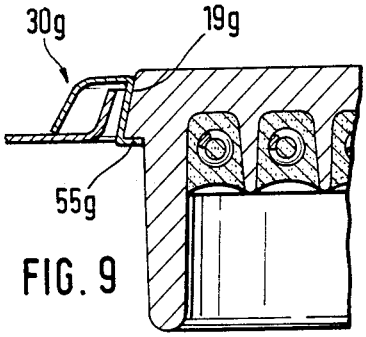

FIG. 9 is similar to FIG. 7, but the support surface 19g is conically tapered upwards. The sheet metal ring 30g is pressed from above by an initial force and is secured by tilting rim sections 55g.

Figure 10:
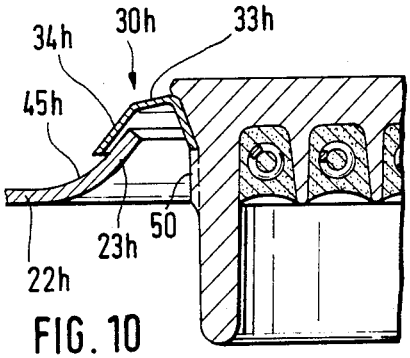
Figure 11:
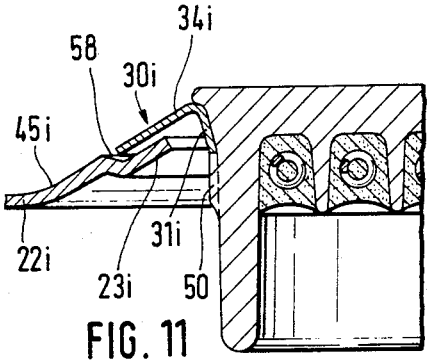

In FIGS. 10 and 11, the sheet metal ring 30h, 30i is arranged on the cooker plate member as in FIGS. 4 and 5. The cooker plate does not have a stamped flange extending beyond the sheet metal ring in this case either, but has a small very low rounded projection which only bridges over the space between the internal section and the intermediate section 33h inclined slightly downwards (FIG. 10) or the external section 34i (FIG. 11) connected directly to the internal section 31i (FIG. 11) and falling flatly outwards.

The fitting plate 22h is FIG. 10 merges via a rounded section 45h into an obliquely inwardly inclined raised rim 23h on which the external section 34h of the sheet metal does not lie, as also in FIG. 11. In this case, the cooker plate is supported on the cooker plate member by supports (not shown). In FIG. 11, the fitting plate 22i has an inwardly directed step 58 to which the flat raised rim 23i is connected. The external section 34i thus merges into the rounded section 45i in a smooth line broken only by a slit.

Figure 12:
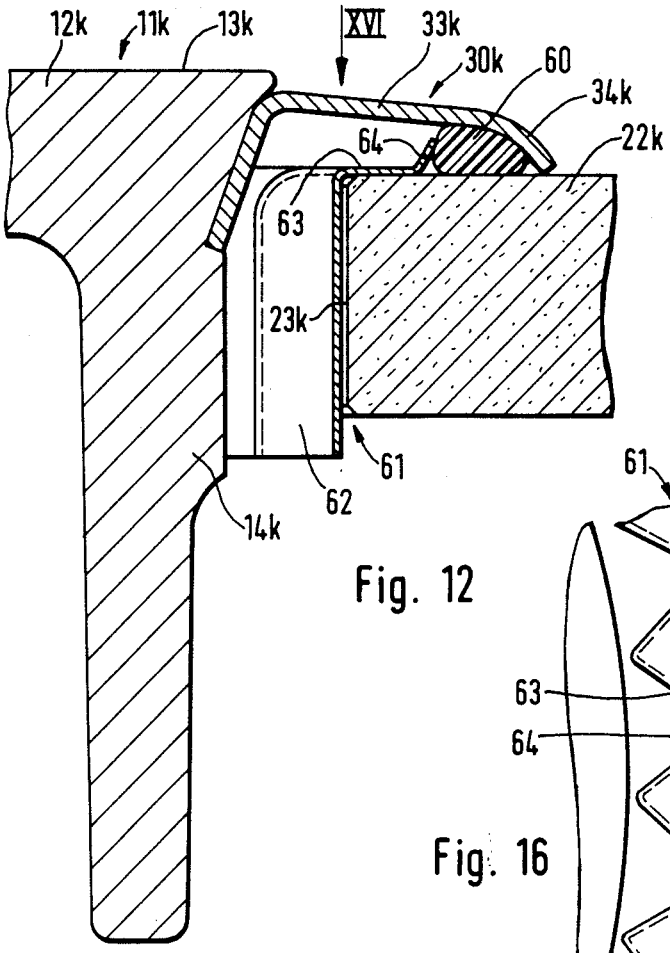
Figure 16:
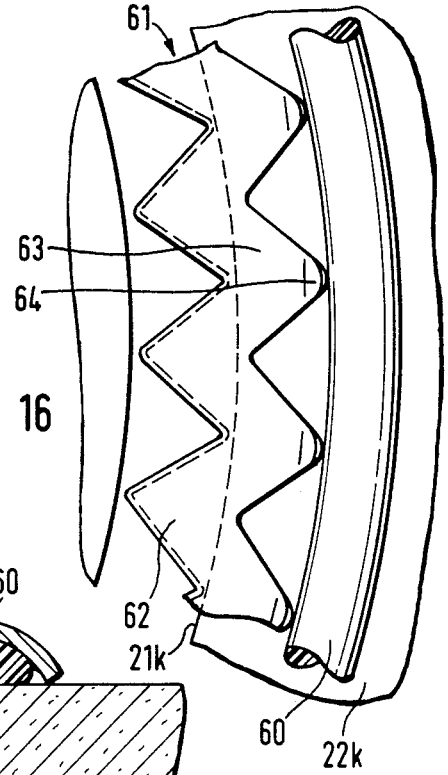
FIG. 16 shows a detail view taken in the direction of arrow XVI in FIG. 12.

FIGS. 12 and 16 show a cooker plate 11k, the cooker plate member 12k and the conical internal section of the sheet metal ring 30k, which is of the same shape as that described with reference to FIGS. 5, 10 and 11.

The intermediate section 33k of the sheet metal ring is broad and frustroconical with a very flat inclination (less than 10° , preferably 5°). Its inner circumference is adjacent to the cooking surface 13k of the cooker plate and lies only very slightly (less than 2 mm and preferably less than 1 mm) below the level of the cooking surface 13k.

The external section 34k of the ring 30k is rounded and terminates in an downwardly extending rim. The height of the external section 34k is, however, so small that the overall height of the ring 30k is not larger than 4 mm, preferably approximately 2.0 mm. It was found that 2.0 mm is an optimum because otherwise a large cooking vessel with a concave bottom will stand on the fitting plate rather than on the cooking surface.

Near the external section 34k, there is a sealing ring 60 interposed between the fitting plate 22k and the lower side of the intermediate section 33k of the ring. The sealing ring consists of a heat resistant sealing material, such as silicone rubber and has a normally circular cross-section which is deformed into a flat oval shape by the pressure of the sheet metal ring. A so-called O-ring can be used. The fitting plate 22k consists of ceramic, glass or glass ceramic and has a substantially flat upper surface. The cooking plate is mounted in a circular opening 21*k* of the fitting plate which is substantially larger in diameter than the outer diameter of the rim 14*k* of the cooking plate member but smaller than the outer diameter of the sheet metal ring.

A spacer ring 61 is inserted between the rim 14 and the wall 23*k* of the opening in order to assure a constant space between the cooker plate and the fitting plate all around the plate 12*k*. The spacer ring 61 also helps to avoid spot overheating of the fitting plate. The spacer ring is formed of sheet metal and has a circular zig-zag shape in its spacer section 62 lying in the space between rim 14 and wall 23*k* of the fitting plate. It has an outwardly extending zig-zag flange 63 terminating in an upwardly inclined rim 64 constituting a centering means for the sealing ring 60 which is thereby held in its position near the outer rim of the external section 34*k*. The spacer ring is inserted into the opening in the fitting plate from above until the flange 63 contacts the upper surface of the fitting plate and thereby positions the spacer ring in its proper place.

Figure 13:
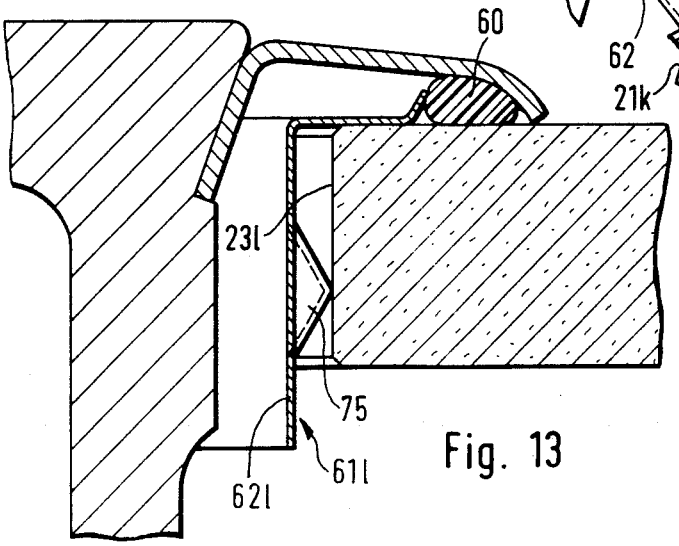

FIG. 13 shows a spacer ring 61L having a spacer section 62L consisting of a cylindrical sheet metal ring. In its wall there are formed six projections 75 on the circumference, projecting outwardly against the wall 23L of the fitting plate. A flange and a centering rim are provided like in FIG. 12.

Figure 14:
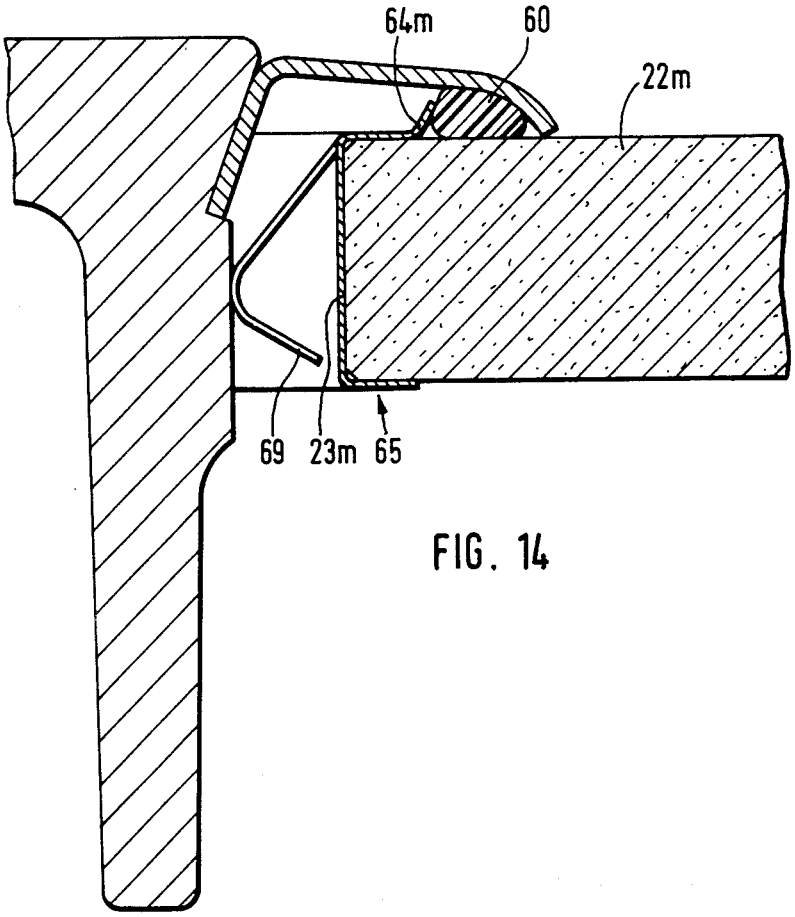

FIG. 14 shows an embodiment in which spacer means are provided consisting of three separate spacer members 65 formed as U-shaped sheet metal clamps contacting the upper and lower surface at the fitting plate 22*m* and the wall 23*m* of the opening in the fitting plate. The upper U-shank of each spacer has an upwardly inclined rim 64*m* for centering the sealing ring 60.

A curved lug 69 is provided pointing against the rim 14 of the coating plate member 12 which resiliently spaces and centers the cooking plate in the opening of the fitting plate 22*m*.

Figure 15:
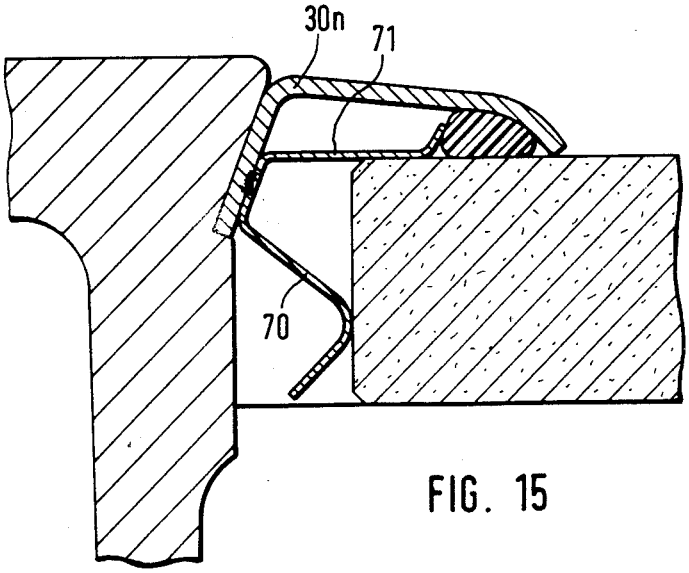

In FIG. 15, there is shown an embodiment in which resilient spacer lugs 70 and centering lugs 71 are fixed on the sheet metal ring 30*n*, e.g. by point welding. The lugs serve to contact the wall of the opening in the fitting plate and the sealing ring respectively and to guide them during the insertion of the cooking plate into the fitting plate. In use, the lugs hold the unit at a constant spacing from the fitting plate.

It will be appreciated that further variations on the disclosed invention are possible and will now be apparent to those skilled in the art. Reference should be made to the appended claims, rather than the foregoing Specification, as defining the true scope of this Invention.

I claim:

1. An electric cooker, comprising:

a fitting plate having an opening surrounded by an upwardly directed rim to prevent entry of liquid into the opening;

a metal cooker plate disposed in the opening, the cooker plate having an electric heating element embedded in electrically insulating material and having a cooking surface on which a cooking vessel can be stood; and, a sheet metal ring surrounding the cooker plate, and projecting beyond the cooker plate, the ring having an irregular, inverted U-shaped cross-section with an internal section which is pressed-fitted and form-fitted to the outer surface of the rim of the cooker plate to hold and seal the cooker plate in the opening of the ring, an external section which overlaps the rim of the fitting plate, and an intermediate section between the internal and external sections, wherein:

(a) the intermediate section is radially wide and slopes downwardly with a flat inclination;

(b) the external section is radially narrow and runs steeply downwards, terminating in a support rim having an edge which rests directly on the upper surface of the fitting plate, the edge being sufficiently thin to prevent capillary action of fluids thereunder; and, (c) the radial dimension of the sheet metal ring is at least two times larger than its largest axial dimension, thereby forming a transition enabling cooking vessels to be pushed smoothly from the cooking surface onto the fitting plate.

2. A cooker according to claim 1, wherein the sheet metal ring defines an annular space, the top of which is adjacent the cooker plate and the upper edge of the rim of the fitting plate, said space having a vertical dimension of at least 2 mm.

3. A cooker according to claim 2, wherein the external diameter of the internal section of the sheet metal ring is dimensioned to correspond to the dimension of the rim of the fitting plate to center the electrical cooker plate in the opening.

* * * * *